US006061544A

United States Patent [19]

Aslam

[11] Patent Number: 6,061,544

[45] Date of Patent: May 9, 2000

[54] MAXIMIZING IMAGE GLOSS UNIFORMITY BY MINIMIZING THE EFFECT OF TEMPERATURE DROOP IN A FUSER FOR REPRODUCTION APPARATUS

[75] Inventor: Muhammed Aslam, Rochester, N.Y.

[73] Assignee: Eastman Kodak Company, Rochester, N.Y.

[21] Appl. No.: 09/197,734

[22] Filed: Nov. 20, 1998

[51] Int. Cl.[7] ..... G03G 15/20

[52] U.S. Cl. ..... 399/330; 219/216

[58] Field of Search ..... 399/328, 329, 399/330, 307; 219/216

[56] References Cited

U.S. PATENT DOCUMENTS

| | | | |
|---|---|---|---|
| 3,452,181 | 6/1969 | Stryjewski . | |
| 3,757,662 | 9/1973 | Ingels | 219/216 |
| 4,883,941 | 11/1989 | Martin et al. | 219/216 |
| 5,055,884 | 10/1991 | Ndebi et al. . | |
| 5,410,392 | 4/1995 | Landa | 399/308 |
| 5,493,378 | 2/1996 | Jamzadeh et al. . | |
| 5,812,906 | 9/1998 | Staudenmayer et al. | 399/69 |
| 5,890,043 | 3/1990 | Uchara | 399/307 |

FOREIGN PATENT DOCUMENTS

| | | |
|---|---|---|
| 6-118815 | 4/1994 | Japan . |
| 7-020736 | 1/1995 | Japan . |
| 7-121049 | 5/1995 | Japan . |
| 8-095422 | 4/1996 | Japan . |
| 9-190112 | 7/1997 | Japan . |

*Primary Examiner*—Robert Beatty
*Attorney, Agent, or Firm*—Lawrence P. Kessler

[57] ABSTRACT

A fuser, for a reproduction apparatus, for permanently fixing a marking particle image to a receiver member transported through said fuser in a fusing direction. The fuser includes a heated fuser member intended to operate at a setpoint temperature. The fuser member is selected to be of a dimension, in the fusing direction, greater than the maximum receiver member size measured in the same direction. For example, the heated fuser member is a roller. Accordingly, a marking particle image will be fused at substantially only one fuser temperature, and will thus exhibit only a single distinct gloss characteristic.

4 Claims, 1 Drawing Sheet

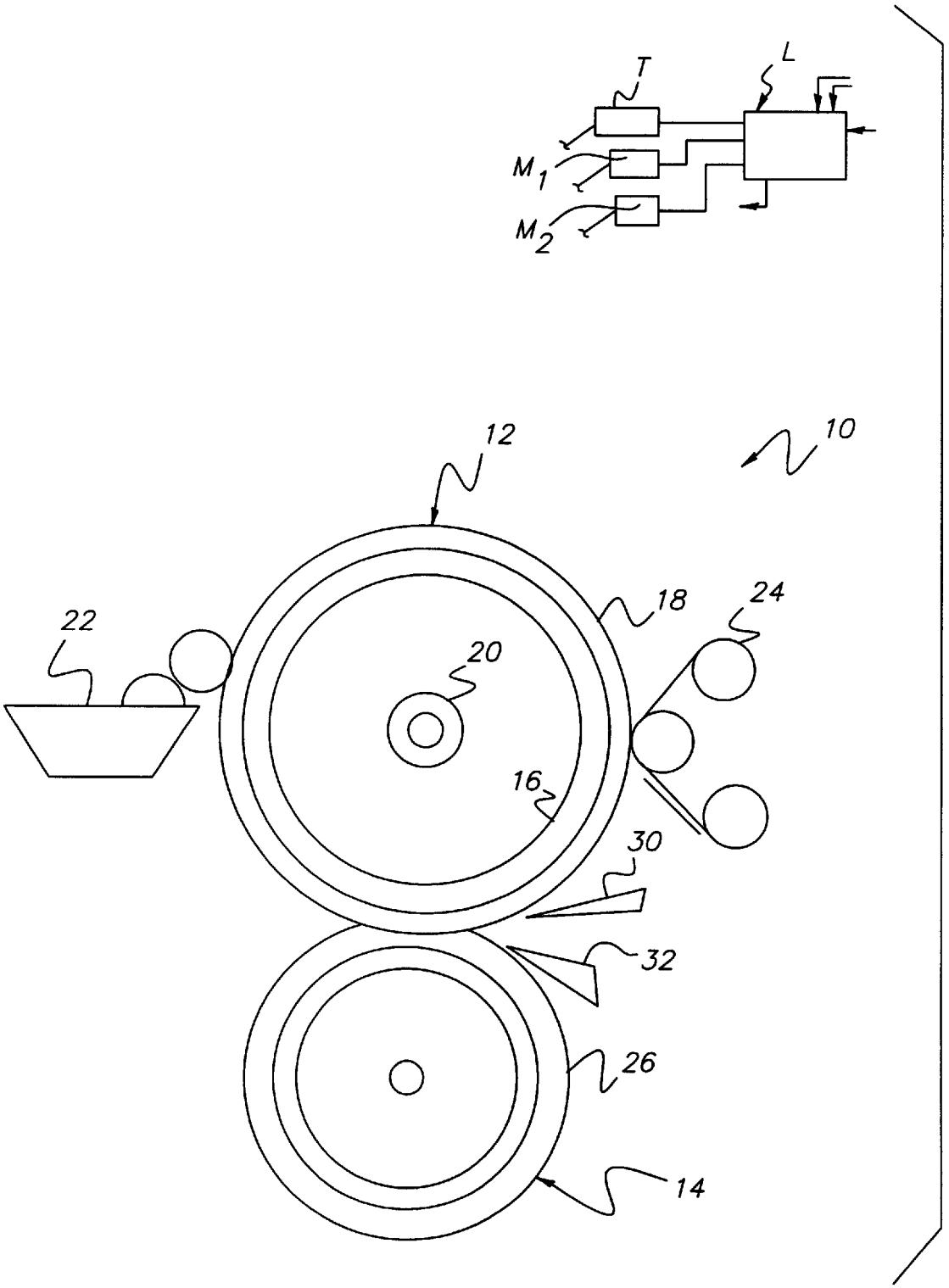
T
L
M1
M2
10
12
18
24
22
20
16
30
32
26
14

MAXIMIZING IMAGE GLOSS UNIFORMITY BY MINIMIZING THE EFFECT OF TEMPERATURE DROOP IN A FUSER FOR REPRODUCTION APPARATUS

CROSS-REFERENCE TO RELATED APPLICATIONS

U.S. Ser. No. 09/197,296, filed Nov. 20, 1998, entitled "FUSER FOR REPRODUCTION APPARATUS WITH MINIMIZED TEMPERATURE DROOP";

U.S. Ser. No. 09/197,365, filed Nov. 20, 1997,entitled "FUSER FOR REPRODUCTION APPARATUS WITH MINIMIZED TEMPERATURE DROOP";

U.S. Ser. No. 09/197,686, filed Nov. 20, 1997, entitled "FUSER FOR REPRODUCTION APPARATUS WITH MINIMIZED TERMPERATURE DROOP";

FIELD OF THE INVENTION

The present invention relates in general to a fuser for a reproduction apparatus, and more particularly to a reproduction apparatus fuser of a configuration for maximizing image gloss uniformity by minimizing the effect of temperature droop in a fuser for reproduction apparatus.

BACKGROUND OF THE INVENTION

In typical commercial reproduction apparatus (electrostatographic copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There the image is fixed to the receiver member by heat and/or pressure from the fuser apparatus to form a permanent reproduction thereon.

One type of fuser apparatus, utilized in typical reproduction apparatus, includes at least one heated roller and at least one pressure roller in nip relation with the heated roller. The fuser apparatus rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

It has been found that the gloss (finished luster) of a fused image is, at least in significant part, due to the temperature at which fusing is accomplished. Further, image gloss needs to be substantially uniform across any individual receiver member, as well as from receiver member to receiver member during a reproduction apparatus job run, to yield high quality reproductions consistent over the job runs. However, as soon as a receiver member passes through the fuser roller nip, the temperature at the outer surface of the fuser roller droops very quickly. Since the temperature droops from the operating setpoint, the logic and control for the reproduction apparatus turns on the fuser heating device. Then, depending upon the thickness of the fuser roller, there is a time lag until the fuser roller surface receives enough energy to get back to the desired fusing temperature setpoint. Therefore, during the time lag, the droop in surface temperature causes inferior fusing quality. When the reproduction apparatus is a process color machine, the temperature droop results in objectionable lower saturation of colors and image gloss. When the receiver member is of a dimension in the direction of travel which requires the fusing roller to rotate through greater than 360° to accomplish fusing, the fusing roller cannot recover to the temperature setpoint. As a result the image will be fused at two distinct fuser temperatures and exhibit two distinct gloss regions. This condition is, of course, objectionable and usually unsatisfactory to the customer.

SUMMARY OF THE INVENTION

In view of the above, this invention is directed to a fuser, for a reproduction apparatus, for permanently fixing a marking particle image to a receiver member transported through said fuser in a fusing direction. The fuser includes a heated fuser member intended to operate at a setpoint temperature. The fuser member is selected to be of a dimension, in the fusing direction, greater than the maximum receiver member size measured in the same direction. For example, the heated fuser member is a roller. Accordingly, a marking particle image will be fused at substantially only one fuser temperature, and will thus exhibit only a single distinct gloss characteristic.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

The FIGURE is a side elevational view of a reproduction apparatus fuser, with portions removed to facilitate viewing, the fuser configured to maximize image gloss uniformity by minimizing the effect of temperature droop according to this invention.

DETAILED DESCRIPTION OF THE INVENTION

Referring now to the accompanying drawings, a typical reproduction apparatus fuser, designated generally by the numeral 10, is shown. The fuser apparatus 10 includes a fuser roller 12 in nip relation with a pressure roller 14. Rotation of the fuser apparatus rollers by any suitable drive mechanism will serve to transport a receiver member bearing a marking particle image through the nip under the application of heat and pressure. The receiver member may be, for example, a sheet of plain bond paper, or transparency material. The heat will soften the marking particles and the pressure will force the particles into intimate contact and to be at least partially imbibed into the fibers at the surface of the receiver material. Thus, when the marking particles cool, they are permanently fixed to the receiver member in an image-wise fashion.

The fuser roller 12 includes a core 16 and a cylindrical fusing blanket 18 supported on the core. The blanket 18 is typically made of a rubber material particularly formulated to be heat conductive or heat insulative dependent upon whether the fuser heat source is located within the core 16 or in juxtaposition with the periphery of the blanket. In the illustrated preferred embodiment, the heat source is an internal heater lamp designated by the numeral 20. A well known suitable oiler mechanism 22 selectively applies an oil to the blanket 18 of the fuser roller to substantially prevent offsetting of the marking particle image to the fuser roller 12. Additionally, a suitable cleaning mechanism 24 wipes the fuser roller surface to remove excess offset preventing oil and other contaminants which would degrade the quality of the image fused to the receiver member.

The pressure roller 14 has a hard outer shell 26. Typically, the shell 26 is made of metal, such as aluminum or steel for example. The shell 26 may also have a well known suitable surface coating (not shown) applied thereto to substantially prevent offsetting of the marking particle image to the pressure roller 14. Skive mechanisms 30 and 32 are respectively associated with the fuser roller 12 and the pressure roller 14 for removing any receiver members which inadvertently adhere to the roller surfaces. Downstream of the nip between the fuser roller 12 and the pressure roller 14 is a transport device, not shown, for feeding receiver members away from the nip.

The fuser apparatus 10 is controlled by a logic and control unit L for the reproduction apparatus. The unit L receives signals, from apparatus processing stations and receiver member location sensors about the processing path, fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

In order to maximize image gloss uniformity by minimizing the effect of fuser roller temperature drop, according to this invention, the fuser 10 is configured such that the circumference of the fuser roller 12, measured in the receiver member transport direction, is substantially larger than the dimension of the largest receiver member, measured in the same direction, to be handled by the fuser. For example, if the fuser roller 12 has an outside diameter of at least 6.05 inches, then the circumference of the roller would be at least 19.0 inches. If then the largest receiver member to be handled by the fuser 10, when measured in the same direction as the fuser roller circumference, is 18.5 inches, at no time would a same area of the fuser roller be required to effect fusing of one receiver member. That is, the fusing roller 12 will not rotate through greater than 360° to accomplish fusing of a single receiver member. Therefore, the fusing roller does not have to recover to the temperature setpoint before the entire single receiver member image has been fused. As a result the image will be fused at substantially only one fuser temperature, and will thus exhibit only a single distinct gloss characteristic.

The invention has been described in detail with particular reference to certain preferred embodiments thereof, but it will be understood that variations and modifications can be effected within the spirit and scope of the invention.

What is claimed is:

1. A fuser, for a reproduction apparatus, for permanently fixing a marking particle image to a receiver member transported through said fuser in a fusing direction, said fuser comprising:

a pressure roller;

a heated fuser member intended to operate at a setpoint temperature, said fuser member (1) forming a nip with the pressure roller, the nip having an inlet at which the receiver member comes into contact with the fuser member and an outlet at which the receiver member is directed away from the fuser member and (2) being selected to be of a dimension, in said fusing direction, greater than the maximum receiver member size measured in the same direction, whereby a marking particle image will be fused at substantially only one fuser temperature, and will thus exhibit only a single distinct gloss characteristic; and a heat source adapted to heat substantially the entire fuser member.

2. The reproduction apparatus fuser according to claim 1 wherein said heated fuser member is a roller having a cylindrical surface entirely heated by the heat source.

3. A fuser, for a reproduction apparatus, for permanently fixing a marking particle image to a receiver member transported through said fuser in a fusing direction, said fuser comprising:

a pressure roller;

a rotatable heated fuser roller operating at a setpoint temperature, said fuser roller (1) forming a nip with the pressure roller, the nip having an inlet at which the receiver member comes into contact with the fuser roller and an outlet at which the receiver member is directed away from the fuser roller and (2) being selected to have a circumferential dimension, measured in the fusing direction, greater than the maximum receiver member size measured in the same direction, whereby said fusing roller will not rotate through greater than 360° to accomplish fusing of a single receiver member, and a marking particle image on said receiver member will be fused at substantially only one fuser temperature; and a heat source adapted to heat substantially the entire fuser roller.

4. In a fuser, for a reproduction apparatus, having a pressure roller and at least one heated fuser member forming a nip with the pressure roller, said fuser member having a circumferential surface with a dimension, measured in a given direction, greater than the maximum receiver member size measured in the same direction, a method for to permanently fix a marking particle image to a receiver member comprising the steps of:

heating said fuser roller entire circumferential surface to an operating setpoint temperature;

directing a receiver member into and out of contact with the fuser member at the nip; and rotating said fuser roller through less than 360° to accomplish fusing of a single receiver member, whereby said marking particle image will be fused at substantially only one fuser roller temperature, and will thus exhibit only a single distinct gloss characteristic.

* * * * *